US012458202B2

(12) United States Patent
Boyer

(10) Patent No.: US 12,458,202 B2
(45) Date of Patent: Nov. 4, 2025

(54) LIFT AND LOAD SILVERWARE BASKET

(71) Applicant: Midea Group Co., Ltd., Guangdong (CN)

(72) Inventor: Joel Boyer, Louisville, KY (US)

(73) Assignee: Midea Group Co., Ltd., Guangdong (CN)

( * ) Notice: Subject to any disclaimer, the term of this patent is extended or adjusted under 35 U.S.C. 154(b) by 0 days.

(21) Appl. No.: 18/592,875

(22) Filed: Mar. 1, 2024

(65) Prior Publication Data

US 2025/0275668 A1 Sep. 4, 2025

(51) Int. Cl.
*A47L 15/50* (2006.01)

(52) U.S. Cl.
CPC ..... *A47L 15/502* (2013.01)

(58) Field of Classification Search
CPC ..... A47L 15/50; A47L 15/501; A47L 15/502; A47L 15/503; A47L 15/504; A47L 15/505; A47L 15/506; A47L 15/507
See application file for complete search history.

(56) References Cited

U.S. PATENT DOCUMENTS 3,288,155 A 11/1966 Swetnam
4,589,556 A * 5/1986 Peretz ..... A47L 15/505 211/41.9
5,069,360 A * 12/1991 Dingler ..... A47L 15/502 220/555
5,287,984 A * 2/1994 Michael ..... A47L 15/502 220/555
5,431,294 A * 7/1995 Stottmann ..... A47L 15/502 220/759
6,161,718 A * 12/2000 Monbo ..... A47L 19/04 220/486

(Continued)

FOREIGN PATENT DOCUMENTS

DE 19907197 A1 * 8/2000 ..... A47L 15/502
DE 60305317 T2 * 2/2007 ..... A47L 15/502

(Continued)

OTHER PUBLICATIONS

Dishwasher repair—replacing the silverware basket (ge part # wd28x10182) URL: https://youtu.be/YONrfxw15Hc (Published: Nov. 20, 2013).

(Continued)

*Primary Examiner* — Patrick D Hawn
(74) *Attorney, Agent, or Firm* — Dinsmore & Shohl LLP

(57) ABSTRACT

In one embodiment, a dishwasher silverware container includes a basket with a front wall and an opposing rear wall. The basket also includes a first side wall and an opposing second side wall. The walls meet to collectively define an interior space of the basket. The basket includes at least one cam track defined within an interior surface of the basket. The dishwasher silverware container also includes a loading tray positionable about the basket. The loading tray includes a cell cover and at least one leg extending from a first side of the cell cover. Each leg has a coupling element positioned on a distal end of the leg such that the coupling element is positioned within the at least one cam track to allow vertical movement of the loading tray with respect to the basket.

20 Claims, 3 Drawing Sheets

(56) References Cited

U.S. PATENT DOCUMENTS

| | | | | |
|---|---|---|---|---|
| 7,073,682 | B2 * | 7/2006 | Raches | A47L 15/502 220/691 |
| 7,267,238 | B2 * | 9/2007 | Yang | A47J 47/20 220/572 |
| 7,861,883 | B2 * | 1/2011 | Purushothaman | A47L 15/502 206/553 |
| 8,104,628 | B2 * | 1/2012 | Kim | A47L 15/503 211/171 |
| 8,377,227 | B2 | 2/2013 | Bengston | |
| 8,522,998 | B2 * | 9/2013 | Crookshanks | A47L 15/502 220/826 |
| 8,733,859 | B2 * | 5/2014 | Shewmaker | A47L 15/502 211/41.9 |
| 9,004,083 | B2 * | 4/2015 | Buhlmeyer | A47L 15/502 134/137 |
| 9,161,674 | B2 * | 10/2015 | Garnett | A47L 15/4257 |
| 9,173,544 | B2 | 11/2015 | Ayvazoglu | |
| 9,635,996 | B2 | 5/2017 | Alwin | |
| 9,661,982 | B2 | 5/2017 | Dabade | |
| 9,848,753 | B2 * | 12/2017 | Chan | A47L 15/505 |
| 9,888,830 | B2 * | 2/2018 | Hirsh | A47L 15/502 |
| 10,531,783 | B1 * | 1/2020 | Carr | A47L 15/502 |
| 10,548,456 | B2 * | 2/2020 | Cao | A47L 15/502 |
| 10,548,457 | B2 | 2/2020 | Hirsh | |
| 10,973,389 | B2 * | 4/2021 | Boyer | A47L 15/507 |
| 11,497,381 | B2 * | 11/2022 | Boyer | A47L 15/507 |
| 11,612,300 | B2 * | 3/2023 | Harr | A47L 15/505 211/41.8 |
| 2002/0139809 | A1 * | 10/2002 | Barry | A47L 15/502 220/762 |
| 2006/0243681 | A1 * | 11/2006 | Bastuji | A47L 15/502 211/41.8 |
| 2009/0255888 | A1 * | 10/2009 | Melvin | A47L 19/04 211/85.29 |
| 2010/0200028 | A1 * | 8/2010 | Buhlmeyer | A47L 15/502 134/137 |
| 2013/0057132 | A1 * | 3/2013 | Flowers | A47L 15/507 312/228.1 |
| 2014/0014605 | A1 * | 1/2014 | Kilgore | A47L 15/501 211/85.25 |
| 2014/0259381 | A1 * | 9/2014 | Fogerlie | A47L 15/502 4/654 |
| 2018/0279851 | A1 * | 10/2018 | Carr | A47L 15/507 |
| 2022/0233053 | A1 * | 7/2022 | Naik | A47L 15/502 |

FOREIGN PATENT DOCUMENTS

| | | | | | |
|---|---|---|---|---|---|
| DE | 102015103781 | A1 * | 10/2015 | | A47L 15/502 |
| DE | 102017205714 | A1 * | 4/2018 | | A47L 15/502 |
| DE | 2021102926 | | 7/2021 | | |
| DE | 102022120063 | A1 * | 2/2024 | | |
| DE | 102024114840 | A1 * | 12/2024 | | |
| DE | 102024115932 | A1 * | 1/2025 | | |
| EP | 1256309 | A1 * | 11/2002 | | A47L 15/502 |
| EP | 2432368 | B1 | 4/2013 | | |
| EP | 2292140 | B1 | 5/2014 | | |
| EP | 2453788 | B1 * | 11/2015 | | A47L 15/502 |
| EP | 3705017 | B1 * | 11/2022 | | A47L 15/503 |
| ES | 2346040 | T3 * | 10/2010 | | A47L 15/503 |
| FR | 2821735 | | 9/2002 | | |
| KR | 20070062295 | A * | 6/2007 | | A47L 15/502 |
| WO | WO2011006727 | | 1/2011 | | |

OTHER PUBLICATIONS

Hisense dishwasher flexible cutlery basket feature URL: https://www.youtube.com/watch?v=fmHwhDD7nTU (Published: Aug. 6, 2021).

Water filter tree bs6801#4 universal dishwasher basket, cutlery caddy, dishwasher baskets for baby bottle parts, baby dishwasher basket, fits most dishwashers, for 1 compartment, 9.45"x 5.5"x 4.7" URL: https://theappliancespros.com/products/universal-dishwasher-cutlery-basket-9-45-x-5-5x-4-7-fits-kenmore-whirlpool-bosch-maytag-kitchenaid-maytag-sam (Published: Jul. 5, 2023).

* cited by examiner

LIFT AND LOAD SILVERWARE BASKET

TECHNICAL FIELD

The present disclosure relates to a dishwasher silverware basket, and more particularly, to a lift and load dishwasher silverware basket configured to be positioned in a loading/unloading position or a washing position.

BACKGROUND

Dishwashers are designed to clean and dry cookware, dishes, and silverware. Dishwashers typically feature an interior washing space defined by a plurality of interior walls, a door, and a pump for providing fluid communication between a water source and the interior washing space. The dishwasher may also include a plurality of racks disposed within the interior washing space configured to accept and position cookware for washing. Dishware, bakeware, glassware and the like may be supported on the rack(s) during washing, while smaller items such as silverware and utensils are placed in a basket to be washed.

In most cases, the basket is supported on a lower rack of the dishwasher. Silverware and other utensils placed in the basket are exposed to washing fluid during the washing operation. Some baskets are permanently mounted to racks, while others are removable so as to allow positioning in various locations in the dishwasher, as well as to facilitate the unloading of silverware. In this manner, the basket can be placed in a location to allow for specific placement of dishware, or removed all together to accommodate the positioning of larger items within the dishwasher.

SUMMARY

In one embodiment, a dishwasher silverware container includes a basket with a front wall and an opposing rear wall. The basket also includes a first side wall and an opposing second side wall. The walls of the basket meet to collectively define an interior space of the basket. The basket includes at least one cam track defined within an interior surface of the basket. The dishwasher silverware container also includes a loading tray positionable about the basket. The loading tray includes a cell cover and at least one leg extending from a first side of the cell cover. The at least one leg has a coupling element positioned on a distal end of the leg such that the coupling element is positioned within the at least one cam track to allow vertical movement of the loading tray with respect to the basket.

In another embodiment, a silverware container includes a basket with a front wall and an opposing rear wall. The basket also includes a first side wall and an opposing second side wall. The walls of the basket meet to collectively define an interior space of the basket. The basket further includes a first cam track defined within an interior surface of the first side wall and a second cam track defined within an interior surface of the second side wall. The silverware container also includes a loading tray positionable about the basket. The loading tray includes a cell cover; a first leg configured to be coupled with the first cam track via a first coupling element, and a second leg configured to be coupled with the second cam track via a second coupling element to enable vertical movement of the loading tray with respect to the basket. The loading tray also includes at least one hook extending approximately perpendicularly from the first leg or the second leg. The loading tray can be movable between two positions. The silverware container has a first mode where the hook interfaces with the basket to maintain the loading tray in a loading/unloading position such that the cell cover is vertically spaced above the basket and the silverware container has a second mode where the hook is disengaged from the basket and disposed within the interior space to maintain the loading tray in a washing position such that the cell cover is positioned proximate the basket to partially enclose the interior space.

Additional features and advantages of the technology described in this disclosure will be set forth in the detailed description that follows, and in part will be readily apparent to those skilled in the art from the description or recognized by practicing the technology as described in this disclosure, including the detailed description that follows, the claims, as well as the appended drawings.

BRIEF DESCRIPTION OF THE DRAWINGS

The embodiments set forth in the drawings are illustrative and exemplary in nature and not intended to limit the disclosure. The following detailed description of the illustrative embodiments can be understood when read in conjunction with the following drawings.

Reference will now be made in greater detail to various embodiments of the present disclosure, some embodiments of which are illustrated in the accompanying drawings. Whenever possible, the same reference numerals will be used throughout the drawings to refer to the same or similar parts.

DETAILED DESCRIPTION

Figure 1:
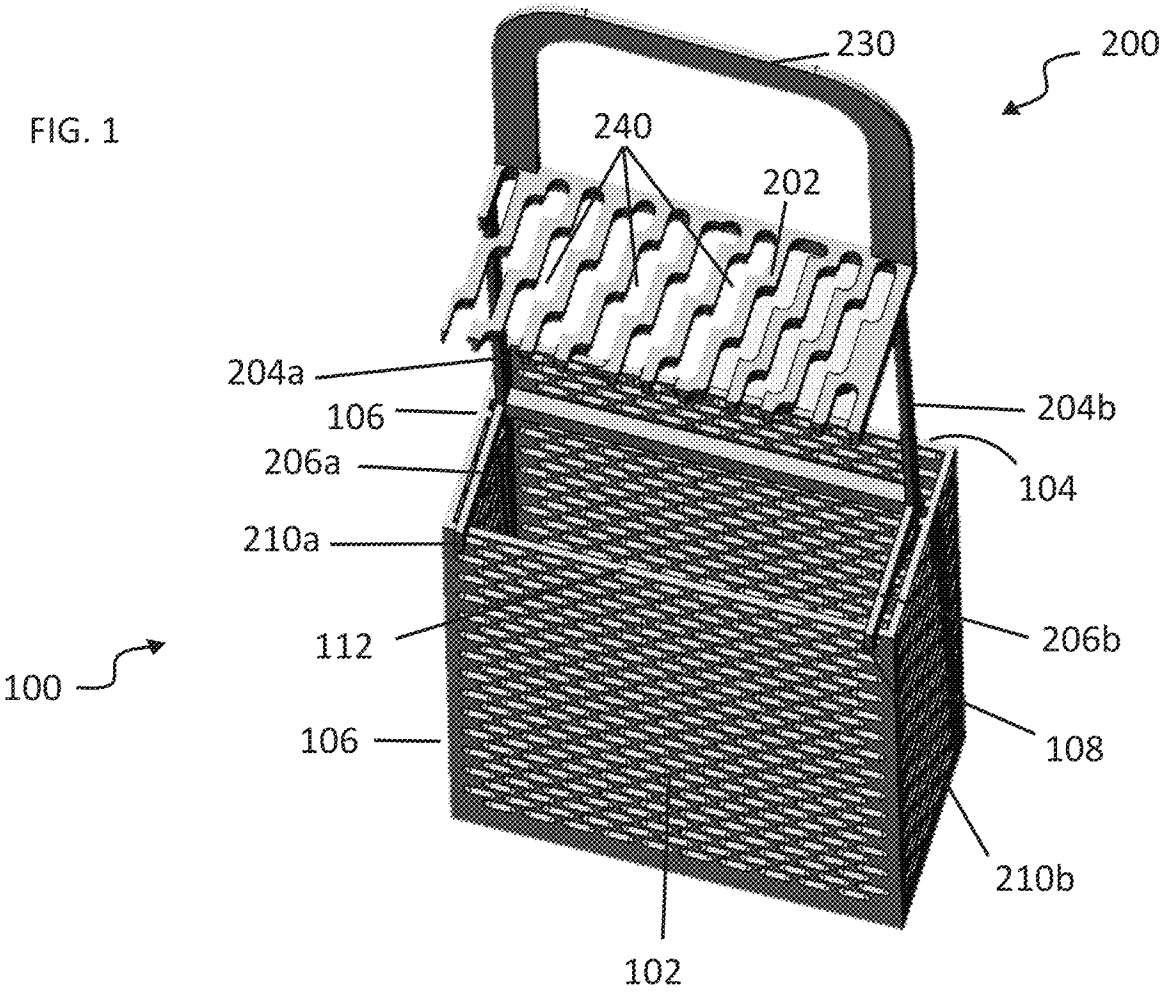
FIG. 1 depicts a perspective view of a loading tray and a basket, wherein the loading tray is positioned in a loading/unloading position, according to embodiments described herein.

One of the challenges presented by current dishwasher technologies is the issue of efficiently arranging and spacing silverware within a dishwasher to achieve adequate cleaning. Conventional silverware baskets merely provide open compartments in which silverware can be placed during a dishwasher washing cycle. However, these conventional silverware baskets lead to inefficient spacing between articles of silverware that may block water flow through the basket and diminish the cleaning efficiency of the dishwasher with regard to the silverware. To overcome this spacing issue, many modern silverware baskets include a cell cover that allows a user to specifically position silverware articles within the cell cover to maintain set distances between each article. In some exemplary baskets, the proximal end of each article of silverware may be placed through the cell cover, leaving the distal end or head of the silverware exposed above the cell cover. However, such arrangements create unintended consequences, requiring a user to touch the head of each article of silverware when loading or unloading the dishwasher. As such, users are forced to come into contact with the dirty end of a used silverware head, or users are forced to handle sanitized silverware heads with potentially non-sanitized hands.

The present disclosure provides for an alternative silverware basket that includes a basket, a loading tray, a cell cover, a cam track system, and at least one hook. The silverware basket of the present disclosure creates a system in which a loading tray may be positionable about the basket and moveable relative to the basket along a cam track. The at least one hook may be positioned on the loading tray and may selectively couple with the basket to enable the loading tray to be positioned in a loading/unloading position. Furthermore, the cell cover may be positioned on an upper portion of the loading tray such that the cell cover is positioned proximate the basket when the loading tray is in the washing position and spaced apart from the basket when the loading tray is in the loading/unloading position. The cell cover may include a plurality of slots that are arranged in staggered, step-like channels that permit articles of silverware to be loaded within the slots using the handles and positioned within the cell cover so that the articles are effectively spaced to ensure optimal cleaning efficiency. Furthermore, the at least one hook may decouple from the basket and the loading tray may be positioned at least partially within the basket to place the silverware basket within a washing position.

As used hereinafter, the term "distal end" in relation to an article of silverware is used to refer to the end of the article of silverware that is meant to contact food products and is positioned away from a user. In contrast, the term "proximal end" in relation to an article of silverware is used to refer to the end of the article of silverware that comprises a handle and is positioned near, and engaged by, the user.

Additionally, as used hereinafter, the term "distal" in relation to the basket or loading tray is used to refer to portions of the basket or loading tray that are positioned near the bottom surface of the silverware basket and/or are designed to face away from a user when seated within a dishwasher device. In contrast, the term "proximal" in relation to the basket or loading tray is used to refer to portions of the basket or loading tray that are positioned near the top of the silverware basket and/or are designed to face toward a user when seated within a dishwasher device.

Basket

Figure 3:
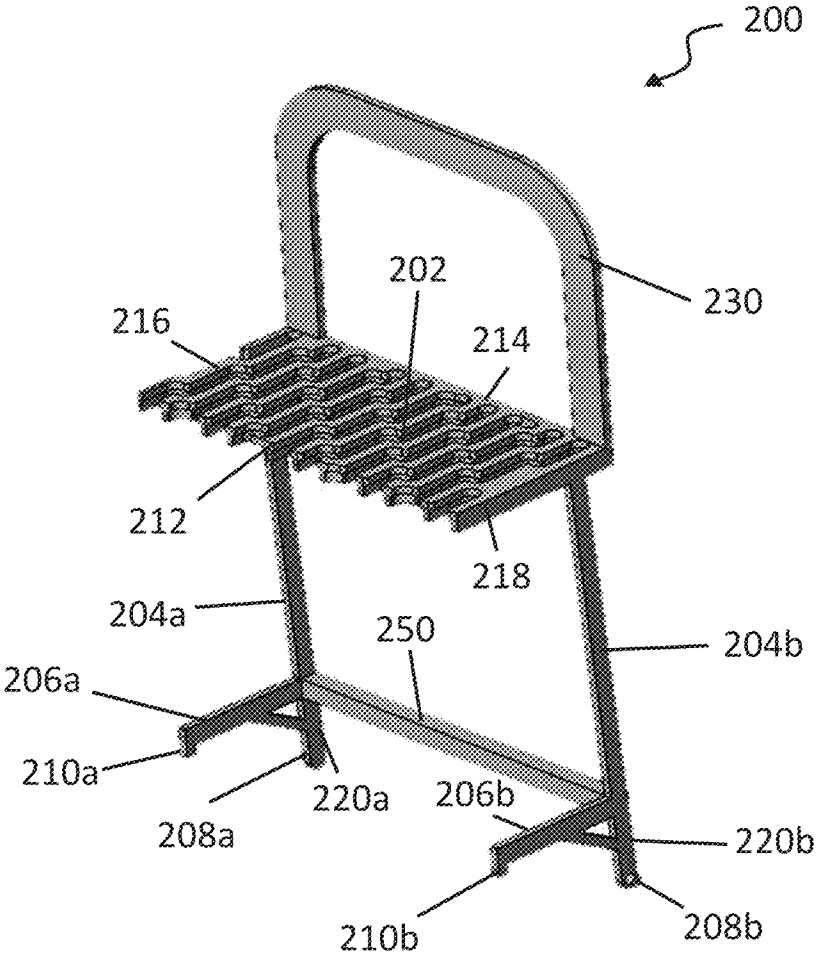
FIG. 3. depicts a perspective view of a loading tray comprising a first leg and a second leg, according to embodiments described herein.

Referring now to FIGS. 1 and 3, the system includes a basket 100 that is made up of a front wall 102, a rear wall 104, a first side wall 106, and a second side wall 108. The basket may optionally include a bottom surface 110. Each of the front wall 102, the rear wall 104, the first side wall 106, and the second side wall 108 extends vertically and meets two adjacent walls to define an outer perimeter of the basket 100. In some embodiments, the front wall 102 may be positioned parallel to the rear wall 104, but positioned as opposing sides of the basket 100. Likewise, the first sidewall 106 may be positioned parallel to the second side wall 108, but positioned as opposing sides of the basket 100. In some embodiments, the front wall 102, the rear wall 104, the first side wall 106, the second side wall 108, and the bottom surface 110 may be joined with each respective adjacent wall 102, 104, 106, 108 or surface 110 at a ninety degree angle. The basket 100 may define a semi-enclosed interior space 140 that is bounded on five sides by an interior surface of each of the front wall 102, the rear wall 104, the first side wall 106, the second side wall 108, and the bottom surface 110, respectively. The interior space 140 may have an opening 142 at an upper end of the basket 100, opposite the bottom surface 110. In other embodiments, the interior space 140 may have an opening 142 at both an upper end of the basket 100 and a bottom end of the basket 100.

Figure 2:
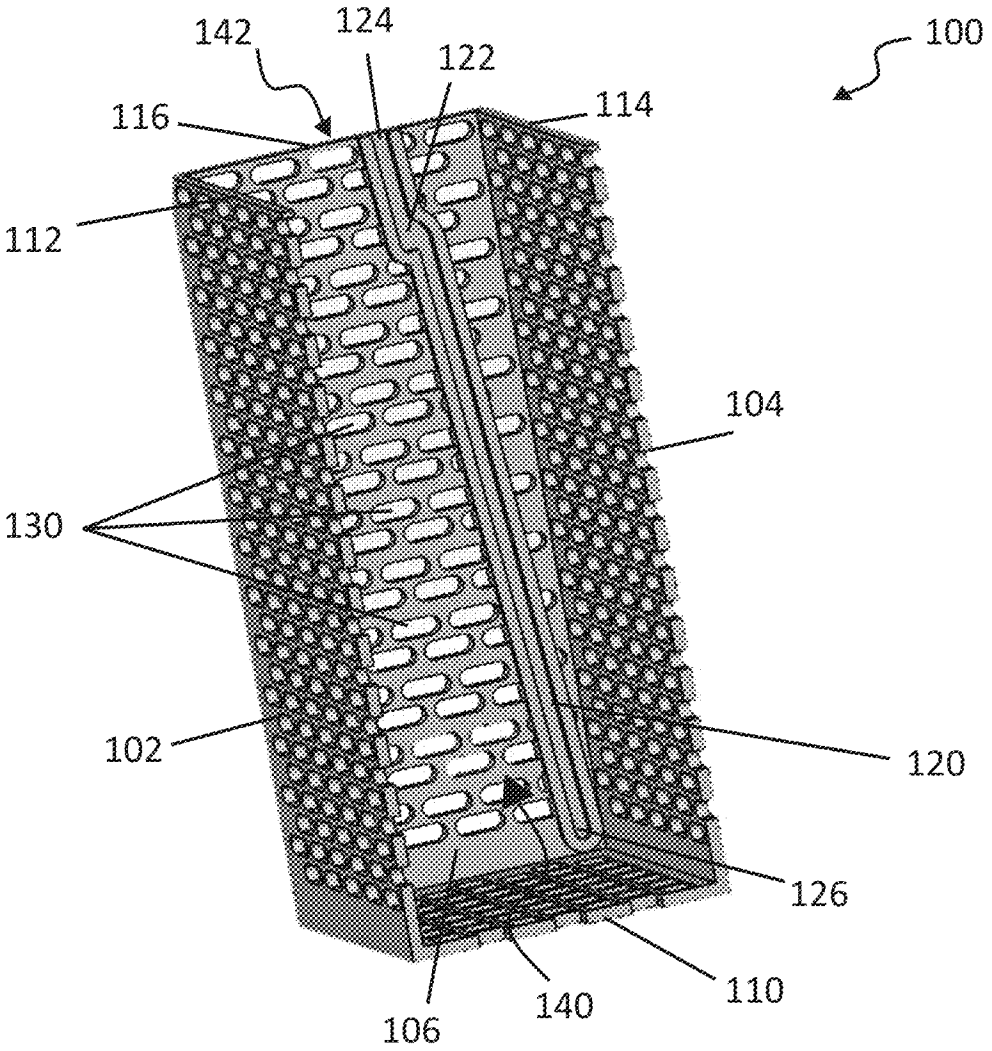
FIG. 2 depicts a cutaway view of a basket, according to embodiments described herein.

In some embodiments the constituent walls 102, 104, 106, 108 and surfaces 110 may form a basket 100 with an overall rectangular prismatic structure. The length of the opposing front wall 102 and rear wall 104 may be greater than the length of the opposing first side wall 106 and second side wall 108, such that the opening 142 has a rectangular cross-sectional area. The dimensions of the opening 142 may be configured to substantially correspond to the dimensions of the loading tray 200 (FIG. 2) and the cell cover 202 (FIG. 2) to enable operative engagement between the basket 100 and the loading tray 200 (FIG. 2), discussed further herein. In some embodiments, each of the walls 102, 104, 106, 108 may have a sufficient thickness to ensure the structural integrity of the basket 100 and create a respective upper edge 112, 114, 116, 118 on an upper surface of each of the walls 102, 104, 106, 108. Each of the upper edges 112, 114, 116, 118 may be flat edge, a rounded edge, or may possess additional features like a protruding lip to allow a hook 206*a*, 206*b* (FIG. 2) to engage and couple with the upper edge 112, 114, 116, 118. In one non-limiting embodiment, the rear wall 104, the first side wall 106, and the second side wall 108 may have each have a uniform upper edge 114, 116, 118, respectively. However, the front wall 102 may have an upper edge 112 that includes an additional feature like a protruding lip to engage and couple with a hook 206*a*, 206*b* (FIG. 2) of the loading tray 200 (FIG. 2) or a retaining element 210*a*, 210*b* (FIG. 2) of the hook 206*a*, 206*b* (FIG. 2).

Referring again to FIG. 3, the basket 100 and its constituent walls 102, 104, 106, 108 and surfaces 110 may be formed from a metal, a molded plastic, or any other suitable material to handle the moisture and temperature conditions of a dishwasher device. In some embodiments, the basket 100 may be formed such that each constituent wall 102, 104, 106, 108 or surface 110 includes a plurality of apertures 130 therethrough to permit fluid communication through the basket 100 into the interior space 140. In alternative embodiments, the plurality of apertures 130 may be punched or otherwise mechanically created in one or more solid constituent walls 102, 104, 106, 108 or surfaces 110. Each of the plurality of apertures 130 may have a circular, ovular, rectangular, or otherwise suitable cross-sectional area to permit fluid communication through the aperture 130 and into the interior space 140 of the basket 100. The plurality of apertures 130 may be uniformly spaced within each of the constituent walls 102, 104, 106, 108 or surfaces 110 or the plurality of apertures 130 may be configured to be concentrated in specific portions of the basket 100 to enable and direct optimal fluid flow through the basket 100. In some embodiments, one or more of the constituent walls 102, 104, 106, 108 or surfaces 110 may possess no apertures 130. In further embodiments, the basket 100 may further include one or more dividers extending from an interior surface of any of the walls 102, 104, 106, 108 or surfaces 110. The dividers may be positioned within the basket 100 so as to create separate compartments for the storage of silverware, while permitting the movement of the loading tray 200 (FIG. 2) within the interior space 140 of the basket 100.

Furthermore, the basket 100 includes at least one cam track 120 defined within an interior surface of one or more of the walls 102, 104, 106, 108. The cam track 120 may have an open channel configured to accept and guide a coupling element 208*a*, 208*b* through the open channel of the cam track 120. In some embodiments, the cam track 120 may be defined within an interior surface of one or more of walls 102, 104, 106, 108 such that the channel of the cam track 120 does not extend beyond the interior surface of the wall 102, 104, 106, 108. In other embodiments, the cam track 120 may protrude inward, toward the interior space 140, such that the cam track 120 extends beyond the interior surface of the wall 102, 104, 106, 108. In some embodiments, the basket 100 may include two cam tracks 120, wherein the cam tracks 120 are positioned opposite one another in the interior surfaces of opposing walls 102, 104, 106, or 108. For instance, the two cam tracks 120 may include a first cam track 120 positioned within an interior surface of the first side wall 106 and a second cam track 120 positioned within an interior surface of the second side wall 108. Alternatively, the two cam tracks 120 may include a first cam track 120 positioned within an interior surface of the front wall 102 and a second cam track 120 positioned within an interior surface of the rear wall 104.

As shown in FIG. 3, each cam track 120 may include a terminal point 126 positioned proximate the bottom end of the basket 100 and an entrance point 124 positioned proximate the opening 142. In embodiments, the terminal point 126 may be positioned proximate the bottom surface 110. The terminal point 126 may form a closed end of the cam track 120, whereas the entrance point 124 may be an open portion of the cam track 120 to permit entry of a coupling element 208*a*, 208*b* (FIG. 2) into the cam track 120. In some embodiments, the entrance point 124 may be positioned at an upper end of the basket 100 such that the entrance point 124 to the cam track 120 is flush with the upper edge 116 of the first side wall 106. The cam track 120 may also be angled such that the cam track 120 slopes toward the rear wall 104 as the cam track 120 progresses from the entrance point 124 toward the terminal point 126. The terminal point 126 may be positioned proximate the rear wall 104 and the entrance point 124 may be positioned in a center of the of the first side wall 106, wherein the distance between the entrance point 124 and the front wall 102 is smaller than the distance between the terminal point 126 and the front wall 102. In some embodiments, the entrance point 124 may be positioned at an upper end of the basket 100 such that the entrance point 124 to the cam track 120 is flush with the upper edge 118 of the second side wall 108. The cam track 120 may also be angled such that the cam track 120 slopes toward the rear wall 104 as the cam track 120 progresses from the entrance point 124 toward the terminal point 126. In some embodiments, the terminal point 126 may be positioned proximate the rear wall 104 and the entrance point 124 may be positioned in a center of the of the second side wall 108, wherein the distance between the entrance point 124 and the front wall 102 is smaller than the distance between the terminal point 126 and the front wall 102. Furthermore, in some embodiments, the cam track 120 may also include a lateral portion 122 wherein the lateral portion 122 is a discontinuity in the otherwise linear cam track 120. In some embodiments, the lateral portion 122 may be a horizontal segment or a substantially horizontal segment of the cam track 120 that is approximately parallel to the bottom surface 110 of the basket 100. The lateral portion 122 of the cam track 120 may permit the coupling elements 208*a*, 208*b* (FIG. 2) of the loading tray 200 (FIG. 2) to move parallel relative to the bottom surface 110 to position the loading tray 200 (FIG. 2) nearer to the front wall 102.

Loading Tray

Referring again to FIG. 2, the dishwasher silverware container further includes a loading tray 200 that is positionable about the basket 100 (FIG. 3). The loading tray 200 includes a cell cover 202, at least one leg 204*a*, 204*b*, and at least one hook 206*a*, 206*b*.

Referring collectively to FIG. 2 and FIG. 3, the cell cover 202 may have a length and width that substantially correspond to the cross-sectional area of the opening 142 (FIG. 3) defined by the front wall 102, the rear wall 104, the first side wall 106, and the second side wall 108. In some embodiments, the cell cover 202 is positionable about the basket 100 at an upper edge 112, 114, 116, 118 of the walls 102, 104, 106, 108, respectively, such that a portion of the first side (e.g., the bottom side) of the cell cover 202 may at least partially enclose the interior space 140 of the basket 100. In other embodiments, the cell cover 202 may have a length and width that are smaller than the length and width of the basket 100 so that the cell cover 202 may be postionable within the opening 142 such that the second side (e.g., a top side) of the cell cover 202 is flush with the upper edges 112, 114, 116, 118. Alternatively, the cell cover 202 may be postionable about the basket 100 such that the cell cover 202 is positioned within the interior space 140 and below the upper edges 112, 114, 116, 118.

Referring once again to FIGS. 2 and 3, the cell cover 202 may include a front edge 212 opposite a rear edge 214 and a first side edge 216 opposite a second side edge 218. The cell cover 202 includes a plurality of slots 240 that form open channels extending through the cell cover 202 from the first side of the cell cover 202 to the second side of the cell cover 202. The plurality of slots 240 may be sized to accommodate a proximal end of an article of silverware while retaining a distal end of the silverware to keep the silverware's distal end in contact with the cell cover 202 during washing. In some embodiments, each of the plurality of slots 240 may have an open end proximate the first edge 212 of the cell cover 202 and a closed end positioned proximate the second edge 214. The open end of each of the plurality of slots 240 may permit a portion of the proximal end of an article of silverware to pass into the slot 240 and position the article within the cell cover 202 for washing. In some embodiments, the plurality of slots 240 may be stepped, wherein each of the plurality of slots comprises a series of alternating longitudinal and transverse portions. Each longitudinal portion of a slot 240 extends substantially parallel to the first side edge 216 and the second side edge 218 of the cell cover 202, whereas each transverse portion of a slot 240 extends substantially parallel to the front edge 212 and the rear edge 214 of the cell cover 202. In some embodiments, the open end of each slot 240 may have a lateral distance to the first side edge 216 that is less than the lateral distance from the closed end of the same slot 240 to the first side edge 216, such that the plurality of slots 240 have a staggered, diagonal arrangement within the cell cover 202. This arrangement may maximize the length of each slot 240 and maintain adequate separation between articles of silverware positioned within the cell cover 202 during washing.

Furthermore, each leg 204*a*, 204*b* of the loading tray 200 may extend from a first side (e.g. a bottom side) of the cell cover 202. Each leg 204*a*, 204*b* includes a coupling element 208*a*, 208*b* positioned on a distal end of the leg 204*a*, 204*b*, such that the coupling element 208*a*, 208*b* is positioned on the portion of the leg 204*a*, 204*b* that is spaced farthest from the cell cover 202. The coupling element 208*a*, 208*b* is configured to be positioned within and move throughout the cam track 120 to guide the vertical movement of the loading tray 200 with respect to the basket 100. In some embodiments, the loading tray 200 includes a first leg 204*a* configured to be coupled with the first cam track 120 positioned on an interior surface of the first side wall 106 via a first coupling element 208*a*, and a second leg 204*b* configured to be coupled with the second cam track 120 positioned on an interior surface of the second side wall 108 via a second coupling element 208*b* to enable vertical movement of the loading tray 200 with respect to the basket 100. The first leg 204*a* may extend from a first side (e.g., a bottom side) of the cell cover 202, specifically the first leg 204*a* may extend from a portion of the cell cover 202 proximate the first side edge 216. The second leg 204*b* may extend from a first side (e.g., a bottom side) of the cell cover 202, specifically the second leg 204*b* may extend from a portion of the cell cover 202 proximate the second side edge 218. In an embodiment, the first leg 204*a* may extend from a first corner proximate the junction of the first side edge 216 and the rear edge 214 and the second leg 204*b* may extend from a second corner proximate the junction of the second side edge 218 and the rear edge 214. In non-limiting embodiments, the legs 204*a*, 204*b* may be angled such that the distal portion of the legs 204*a*, 204*b* extends beyond the footprint of the cell cover 202.

The coupling elements 208*a*, 208*b* may be protrusions extending laterally from an exterior portion of the first leg 204*a* and the second leg 204*b* respectively, such that a first coupling element 208*a* extends from the first leg 204*a* toward the interior surface of the first side wall 106 and a second coupling element 208*b* extends from the second leg 204*b* toward the interior surface of the second side wall 108. In some embodiments, each coupling element 208*a*, 208*b* may be a rolling element that is sized to fit within the open channel of the cam track 120 and move freely along the cam track 120 to allow a user to easily position the loading tray 200 with respect to the basket 100 by applying a force to the loading tray 200 along the vertical axis. The coupling element 208*a*, 208*b* may be selected from wheels, rollers, ball bearing systems, pins, or other suitable means to enable unimpeded, vertical movement of the loading tray 200 along the cam track 120.

In some embodiments, as depicted in FIG. 2, the loading tray 200 may include a handle 230 to facilitate user interaction with the loading tray 200. The handle 230 may extend vertically from a second side of the cell cover 202 opposite the first side. The handle 230 may be a U-shaped handle 230 extending from a single edge 212, 214, 216, 218 of the cell cover 202, so as to avoid blocking the silverware holding areas of the cell cover 202. In an embodiment, the handle 230 may extend vertically from the rear edge 214 of the cell cover 202, such that a first portion of the handle 230 extends from a first corner proximate the junction of the first side edge 216 and the rear edge 214 and a second portion of the handle 230 extends from a second corner proximate the junction of the second side edge 218 and the rear edge 214. In alternative embodiments, the loading tray 200 may include two handles 230 extending from opposite sides of the cell cover 202. In other embodiments, the loading tray 200 may include a single handle 230 extending from a middle portion of the first side edge 216 to a middle portion of the second side edge 218. In still other embodiments, no handle is included.

The loading tray 200 may also include a cross member 250 extending between the first leg 204*a* and the second leg 204*b*. The cross-member 250 may be a longitudinal support bar that couples the first leg 204*a* with the second leg 204*b* to allow the first leg 204*a* and the second leg 204*b* to remain thin and lightweight while retaining mechanical integrity. In some embodiments, the cross member 250 extends between the first leg 204*a* and the second leg 204*b*, parallel to the cell cover 202 and is positioned at a distal portion of the legs 204*a*, 204*b*, proximate the coupling elements 208*a*, 208*b*. In other embodiments, the loading tray 200 may include other numbers of cross members, including, for example, zero cross members or two or more cross members 250. In embodiments with two cross members 250, the cross members 250 can be oriented in several configurations, including but not limited to, an orientation wherein the cross members 250 intersect one another to form X-shaped cross members extending between the first leg 204*a* and the second leg 204*b*. Furthermore, each leg 204*a*, 204*b* includes a foot 220*a*, 220*b*, wherein the foot 220*a*, 220*b* comprises the portion of the leg 204*a*, 204*b* that extends below the cross member 250. In some embodiments, each coupling element 208*a*, 208*b* extends from each foot 220*a*, 220*b* of each leg 204*a*, 204*b*.

Still referring to FIG. 2, the loading tray 200 includes at least one hook 206*a*, 206*b* coupled to at least one leg 204*a*, 204*b*. In some embodiments, the first leg 204*a* includes a first hook 206*a* positioned at a distal end of the first leg 204*a* and the second leg 204*b* includes a second hook 206*b* positioned at a distal end of the second leg 206*b*, each hook 206*a*, 206*b* extending from each leg 204*a*, 204*b* parallel to the cell cover 202. The first hook 206*a* extends from the first leg 204*a* toward the front wall 102 (FIG. 3), such that the first hook 206*a* is vertically spaced approximately below the first side edge 216 of the cell cover 202. The second hook 206*b* extends from the second leg 204*b* toward the front wall 102 (FIG. 3), such that the second hook 206*b* is vertically spaced approximately below the second side edge 218 of the cell cover 202. In some embodiments, each hook 206*a*, 206*b* may include a retaining element 210*a*, 210*b* positioned at a terminal portion of the hook 206*a*, 206*b* (i.e., the portion of the hook 206*a*, 206*b* that is positioned nearest to the front wall 102 of the basket 100). The retaining element 210*a*, 210*b* may be a protrusion that extends vertically below a bottom surface of each hook 206*a*, 206*b* to couple each hook 206*a*, 206*b* with an upper edge 112, 114, 116, 118 (FIG. 3) of a basket 100. In alternative embodiments, each hook 206*a*, 206*b* may be a telescoping hook 206*a*, 206*b*, wherein each hook 206*a*, 206*b* includes an inner tube and an outer tube. The inner tube may be moveable along a lateral axis such that the inner tube can extended relative to the outer tube. For example, the inner tube of the telescoping hook 206*a*, 206*b* may extend laterally, away from the legs 204*a*, 204*b* and toward the front wall 102 (FIG. 3). In alternative embodiments, the outer tube may be moveable relative to the inner tube to achieve the same functionality.

Interaction Between the Basket and the Loading Tray

Referring now collectively to FIGS. 1-3, the loading tray 200 is configured to interact with the basket 100, such that the loading tray 200 is vertically postionable relative to the basket 100. As discussed herein, each coupling element 208*a*, 208*b* may engage with a cam track 120 to enable the coupling element 208*a*, 208*b* to move vertically within the cam track 120. By extension, the movement of the coupling elements 208*a*, 208*b* within the cam tracks 120 permits the loading tray 200 to move vertically relative to the basket 100. In some embodiments, the loading tray 200 includes a first leg 204*a* that is coupled with a first cam track 120 positioned within an interior surface of the first side wall 106 via a first coupling element 208*a*, and a second leg 204*b* that is coupled with a second cam track 120 positioned within an interior surface of the second side wall 108 via a second coupling element 208*b*, wherein the loading tray 200 can vertically extend above the basket 100 due to the movement of the coupling elements 208*a*, 208*b* upwardly within the cam tracks 120. The coupling elements 208*a*, 208*b* may be coupled within the cam tracks 120 such that they only restrict lateral or transverse movement, but permit vertical and rotational movement within the cam tracks 120. In some embodiments, the coupling elements 208*a*, 208*b* may function as pivots, wherein the loading tray 200 may freely pivot about the coupling elements 208*a*, 208*b* such that the loading tray 200 may tilt forward to enable each hook 206*a*, 206*b* extending from each leg 204*a*, 204*b* may interface with an upper edge 112, 114, 116, 118 of the basket 100. In some embodiments, each hook 206*a*, 206*b* may interface with an upper edge 112 of the front wall 102.

The dishwasher silverware container of the present disclosure enables the loading tray 200 to be postionable relative to the basket 100 in at least two configurations or modes: a washing position and a loading/unloading position. The loading tray 200 may be positioned in the washing position when each leg 204*a*, 204*b* and each hook 206*a*, 206*b* of the loading tray 200 is fully disposed within the interior space 140 of the basket 100, wherein the cell cover 202 is positioned about the basket 100 such that the cell cover 202 at least partially encloses the interior space 140, as discussed herein. In the wash position, each of the coupling elements 208*a*, 208*b* is engaged with the cam track 120 and positioned proximate the terminal point 126 of the cam track 120 so that the loading tray 200 is positioned at its lowest vertical position.

Alternatively, the loading tray 200 may be positioned in a loading/unloading position, such that the cell cover 202 is vertically spaced from the basket 100, when each coupling element 208*a*, 208*b* is advanced vertically along each cam track 120 until each coupling element 208*a*, 208*b* meets the lateral portion 122 of the cam track 120. The coupling elements 208*a*, 208*b* may move laterally toward the front wall 102 within the lateral portion 122 of the cam track 120. Additionally, the loading tray 200 may pivot about each coupling element 208*a*, 208*b* when positioned within the lateral portion 122 such that the loading tray 200 can tilt toward the front wall 102 while the coupling element 208*a*, 208*b* is positioned within the cam track 120. Due to the lateral movement and pivot of the loading tray 200, each hook 206*a*, 206*b* extending approximately perpendicularly from each leg 204*a*, 204*b* can be positioned forward to interface with the basket 100. In some embodiments, the loading tray 200 may pivot about the coupling elements 208*a*, 208*b* to lean forward relative to the basket 100 such that the bottom surface of each hook 206*a*, 206*b* may engage with an upper edge 112, 114, 116, 118 of a wall 102, 104, 106, 108 of the basket 100 to support the loading tray 200 and maintain the loading tray 200 in the loading/unloading position. In some embodiments, each hook 206*a*, 206*b* may interface the basket 100 due to both the lateral movement of the coupling elements 208*a*, 208*b* and the pivot of the loading tray 200, while in other embodiments each hook 206*a*, 206*b* may engage the basket 100 due to either the lateral movement of the coupling elements 208*a*, 208*b* or the pivot of the loading tray 200. In some embodiments, each hook 206*a*, 206*b* may further include a retaining element 210*a*, 210*b* to engage with and partially surround an upper edge 112, 114, 116, 118 of a wall 102, 104, 106, 108 of the basket 100 maintain the loading tray 200 in the loading/unloading position. In a non-limiting embodiment, each hook 206*a*, 206*b* may engage with the front wall 102 to maintain the basket 100 in the loading/unloading position.

Once the loading tray 200 has been loaded or unloaded, the loading tray 200 may be returned to the washing positon. To re-enter the washing positon, the process is reversible, wherein each hook 206*a*, 206*b* may be disengaged from the basket 100, the loading tray 200 may be rotated about the coupling elements 208*a*, 208*b* so that the loading tray 200 is no longer leaning forward relative to the basket 100, and the coupling elements 208*a*, 208*b* may be retracted back along the lateral portion 122 and down the cam track 120 until each coupling element 208*a*, 208*b* is positioned proximate the terminal point 126. In so doing, each leg 204*a*, 204*b* and each hook 206*a*, 206*b* may be fully disposed within the interior space 140 of the basket 100 and the cell cover 202 is positioned about the basket 100 such that the cell cover 202 at least partially encloses the interior space 140, as discussed herein.

It may be noted that one or more of the following claims utilize the terms "where," "wherein," or "in which" as transitional phrases. For the purposes of defining the present technology, it may be noted that these terms are introduced in the claims as an open-ended transitional phrase that are used to introduce a recitation of a series of characteristics of the structure and should be interpreted in like manner as the more commonly used open-ended preamble term "comprising."

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise structure, steps, and/or forms disclosed, and obviously many modifications and variations are possible in light of the above teaching.

The invention claimed is:

1. A dishwasher silverware container, comprising:

a basket further comprising a front wall and an opposing rear wall, and a first side wall and an opposing second side wall, wherein each of the front wall, the rear wall, the first side wall, and the second side wall comprises an interior surface such that each interior surface collectively define an interior space;

at least one cam track defined within one interior surface of the basket, the cam track comprising an entrance point configured to removably receive a loading tray within the cam track; and the loading tray positionable about the basket, the loading tray further comprising:

a cell cover; and at least one leg extending from a first side of the cell cover, wherein said at least one leg has a coupling element positioned on a distal end thereof such that the coupling element is positioned within the at least one cam track to allow vertical movement of the loading tray with respect to the basket.

2. The dishwasher silverware container of claim 1, wherein the at least one cam track further comprises a first cam track positioned within an interior surface of the first side wall and a second cam track positioned within an interior surface of the second side wall.

3. The dishwasher silverware container of claim 2, wherein the at least one leg further comprises a first leg that is coupled with the first cam track via a first coupling element and a second leg that is coupled with the second cam track via a second coupling element.

4. The dishwasher silverware container of claim 3, wherein each of the first cam track and the second cam track is angled such that each cam track has a terminal point positioned proximate the rear wall and the entrance point positioned in a center of the first or the second side wall so that the distance between the entrance point and the front wall is smaller than the distance between the terminal point and the front wall.

5. The dishwasher silverware container of claim 1, wherein the coupling element further comprises a rolling element selected from wheels, rollers, ball bearing systems, or pins, to permit vertical movement of the loading tray along the cam track.

6. The dishwasher silverware container of claim 1, wherein the loading tray further comprises a handle extending from a second side of the cell cover opposite the first side.

7. The dishwasher silverware container of claim 1, wherein one or more of a bottom surface, the front wall, the rear wall, the first side wall, the second side wall, and the cell cover each define a plurality of apertures therethrough to permit fluid communication through the basket to the interior space.

8. The dishwasher silverware container of claim 1, wherein the cell cover is positionable at an upper edge of each of the front wall, the rear wall, the first side wall, and the second side wall to partially enclose the interior space.

9. The dishwasher silverware container of claim 1, wherein the cell cover defines a plurality of slots extending from a first edge to a second edge opposite the first edge, wherein each slot in the plurality of slots is open proximate the first edge and closed proximate the second edge.

10. The dishwasher silverware container of claim 9, each slot comprising a series of alternating longitudinal and transverse portions, wherein each longitudinal portion extends parallel to a first side edge and a second side edge of the cell cover and each transverse portion extends perpendicular to the longitudinal portions.

11. A silverware container, comprising:

a basket comprising a front wall and an opposing rear wall and a first side wall and an opposing second side wall, wherein each of the front wall, the rear wall, the first side wall, and the second side wall comprises an interior surface such that each interior surface collectively define an interior space;

a first cam track defined within the interior surface of the first side wall and a second cam track defined within the interior surface of the second side wall, each of the first cam track and the second cam track comprising an entrance point configured to removably receive a loading tray within the cam track; and the loading tray positionable about the basket, the loading tray further comprising:

a cell cover;

a first leg configured to be coupled with the first cam track via a first coupling element, and a second leg configured to be coupled with the second cam track via a second coupling element, to enable vertical movement of the loading tray with respect to the basket; and at least one hook extending approximately perpendicularly from the first leg or the second leg, wherein the loading tray can be movable between two positions, wherein in a first mode the at least one hook interfaces with the basket to maintain the loading tray in a loading/unloading position such that the cell cover is vertically spaced above the basket, and in a second mode the at least one hook is disengaged from the basket and disposed within the interior space to maintain the loading tray in a washing position such that the cell cover is positioned proximate the basket to partially enclose the interior space.

12. The silverware container of claim 11, wherein:

the at least one hook comprises a first hook and a second hook, the first leg further comprises the first hook positioned at a distal end of the first leg, extending perpendicularly from the first leg toward the front wall, and wherein the second leg comprises the second hook positioned at a distal end of the second leg, extending perpendicularly from the second leg toward the front wall.

13. The silverware container of claim 11, wherein each of the first cam track and the second cam track are angled such that each cam track has a terminal point positioned proximate the rear wall and the entrance point positioned in a center of the first side wall or the second side wall so that the distance between the entrance point and the front wall is smaller than the distance between the terminal point and the front wall.

14. The silverware container of claim 13, wherein each cam track further comprises a lateral portion that permits the loading tray to move approximately parallel relative to a bottom surface to position each hook proximate the front wall.

15. The silverware container of claim 11, wherein the loading tray is free to pivot about the first coupling element or the second coupling element such that each hook is configured to interface with an upper edge of the front wall to fix the loading tray in the loading/unloading position.

16. The silverware container of claim 11, wherein each hook is a telescoping hook comprising an inner tube and an outer tube, such that the inner tube is configured to extended relative to the outer tube to interface with the front wall.

17. The silverware container of claim 11, wherein each hook comprises a retaining element extending from a terminal end of the hook configured to interact with an upper edge of the front wall.

18. The silverware container of claim 11, the loading tray further comprising a cross member extending between the first leg and the second leg and each of the first leg and the second leg further comprises a foot below the cross member, wherein each of the first coupling element and the second coupling element extends from each foot.

19. The silverware container of claim 11, wherein each of the first coupling element and the second coupling element comprises a rolling element selected from wheels, rollers, ball bearing systems, pins, or other suitable means to permit movement within each cam track.

20. A silverware container, comprising:

a basket comprising a front wall and an opposing rear wall and a first side wall and an opposing second side wall, wherein each of the front wall, the rear wall, the first side wall, and the second side wall comprises an interior surface such that each interior surface collectively define a basket interior space;

a first cam track defined within the interior surface of the first side wall and a second cam track defined within the interior surface of the second side wall, each of the first cam track and the second cam track comprising an entrance point configured to removably receive a loading tray within the cam track, wherein each of the first cam track and the second cam track are angled such that each cam track has a terminal point positioned proximate the rear wall and the entrance point positioned in a center of the first side wall or the second side wall so that the distance between the entrance point and the front wall is smaller than the distance between the terminal point and the front wall and each cam track further comprises a lateral portion that permits the loading tray to move approximately parallel relative to a bottom surface to position a first hook and a second hook proximate the front wall; and a loading tray positionable about the basket, the loading tray further comprising:

a cell cover;

a first leg configured to be coupled with the first cam track via a first coupling element, and a second leg configured to be coupled with the second cam track via a second coupling element, to enable vertical movement of the loading tray with respect to the basket; and the first hook extending approximately perpendicularly from the first leg and the second hook extending approximately perpendicularly the second leg, wherein the loading tray can be movable between two positions, wherein in a first mode the first hook and the second hook interface with the basket to maintain the loading tray in a loading/unloading position such that the cell cover is vertically spaced above the basket, and in a second mode the first hook and the second hook are disengaged from the basket and disposed within the basket interior space to maintain the loading tray in a washing position such that the cell cover is positioned proximate the basket to partially enclose the basket interior space.

* * * * *